US010247478B2

(12) United States Patent
Kohno et al.

(10) Patent No.: US 10,247,478 B2
(45) Date of Patent: Apr. 2, 2019

(54) MONOLITHIC REFRACTORY STRUCTURE

(71) Applicant: NIPPON STEEL & SUMITOMO METAL CORPORATION, Tokyo (JP)

(72) Inventors: Kohji Kohno, Kisarazu (JP); Hiroki Tsukigase, Kimitsu (JP); Ryuichi Ishikawa, Kimitsu (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 14/763,376

(22) PCT Filed: Jan. 29, 2014

(86) PCT No.: PCT/JP2014/052010

§ 371 (c)(1),
(2) Date: Jul. 24, 2015

(87) PCT Pub. No.: WO2014/119632

PCT Pub. Date: Aug. 7, 2014

(65) Prior Publication Data

US 2015/0362253 A1 Dec. 17, 2015

(30) Foreign Application Priority Data

Jan. 29, 2013 (JP) ..... 2013-014504

(51) Int. Cl.

| | |
|---|---|
| ***F27D 1/00*** | (2006.01) |
| ***F27D 1/10*** | (2006.01) |
| ***F27D 1/14*** | (2006.01) |

(52) U.S. Cl.

CPC ..... *F27D 1/10* (2013.01); *F27D 1/141* (2013.01); *F27D 2001/0059* (2013.01); *F27D 2001/0079* (2013.01); *Y10T 428/24942* (2015.01)

(58) Field of Classification Search

CPC ..... F27B 1/12; F27D 1/0009; F27D 1/141; F27D 1/14; F27D 1/148

See application file for complete search history.

(56) References Cited

U.S. PATENT DOCUMENTS 3,766,000 A * 10/1973 Gibson ..... C04B 35/806 156/89.26
3,771,467 A * 11/1973 Sweet ..... F27D 1/14 110/336

(Continued)

FOREIGN PATENT DOCUMENTS

CN 202329167 U 7/2012
JP 49-7125 A 1/1974

(Continued)

OTHER PUBLICATIONS

Chinese Office Action and Search Report dated Mar. 23, 2016, for Chinese Application No. 201480006125.3 with the English translation of the Search Report.

(Continued)

*Primary Examiner* — Humera N Sheikh
*Assistant Examiner* — Elizabeth D Ivey
(74) *Attorney, Agent, or Firm* — Birch, Stewart, Kolasch & Birch, LLP

(57) ABSTRACT

A monolithic refractory structure includes: a monolithic refractory; a support body which supports the monolithic refractory; and a heat-resistant fiber support material which is buried in the monolithic refractory in a state of being connected to a support surface of the support body. The heat-resistant fiber support material includes a heat-resistant fiber rope which is formed of an inorganic fiber and extends along an X-axis direction perpendicular to the support surface, and a ratio L1/L2 of an X-axis direction length L1 of the heat-resistant fiber rope to an X-axis direction length (Continued)

L2 of the monolithic refractory is 0.35 or more and 0.95 or less.

5 Claims, 13 Drawing Sheets

(56) References Cited

U.S. PATENT DOCUMENTS

| | | | | |
|---|---|---|---|---|
| 2010/0119425 | A1* | 5/2010 | Palmer | C21B 7/06 422/241 |
| 2011/0011051 | A1* | 1/2011 | Wienke | F16G 13/12 59/84 |

FOREIGN PATENT DOCUMENTS

| | | | | | |
|---|---|---|---|---|---|
| JP | 52-85906 | A | | 7/1977 | |
| JP | 61-197497 | U | | 12/1986 | |
| JP | 6-317385 | A | | 11/1994 | |
| JP | 7-24961 | U | | 5/1995 | |
| JP | 7-32493 | U | | 6/1995 | |
| JP | 9-143535 | A | | 6/1997 | |
| JP | 10-197161 | A | | 7/1998 | |
| JP | 2001-201268 | A | | 7/2001 | |
| JP | 2004-92983 | A | | 3/2004 | |
| JP | 2005-042967 | A | * | 2/2005 | F27D 1/14 |
| JP | 2005-42967 | A | | 2/2005 | |
| JP | 2005-55010 | A | | 3/2005 | |
| JP | 2010-107091 | A | | 5/2010 | |
| JP | 2013-76488 | A | | 4/2013 | |
| JP | 5420878 | B2 | | 2/2014 | |

OTHER PUBLICATIONS

International Search Report, issued in PCT/JP2014/052010 dated Apr. 22, 2014.
Office Action, issued in JP 2013-014504, dated Apr. 22, 2014.
Written Opinion of the International Searching Authority, issued in PCT/JP2014/052010, dated Apr. 22, 2014.
Korean Office Action, dated Sep. 9, 2016, for Korean Application No. 10-2015-7020704, together with an English translation thereof.

* cited by examiner (0.35≦L1/L2≦0.95)

(L1/L2<0.35)

MONOLITHIC REFRACTORY STRUCTURE

TECHNICAL FIELD OF THE INVENTION

The present invention relates to a monolithic refractory structure.

Priority is claimed on Japanese Patent Application No. 2013-014504, filed on Jan. 29, 2013, the content of which is incorporated herein by reference.

RELATED ART

In various types of industrial furnaces and facilities used under a high temperature, such as ironworks, various types of refractories such as firebricks, monolithic refractories, ceramic fiber, and the like are constructed depending on the use environment or necessary functions. In recent years, among these, the use of monolithic refractories (castable and plastic refractories and the like) has increased due to an increase in the degree of freedom of construction and shape and an increase in quality.

Inside the monolithic refractory, a metal support material typically called an anchor or stud, processed to an L-shape, a V-shape, or a Y-shape is buried. An end portion of the metal support material is fixed to a shell or pipe which is a support body of the monolithic refractory. The metal support material has a role of preventing the monolithic refractory from being peeled off or separated from the support body such as the shell or pipe or suppressing the propagation of a crack that occurs in the monolithic refractory.

Specifically, as shown in FIG. 16, an existing monolithic refractory structure includes a support body 1, metal support materials 2 such as a metal stud or anchor fixed to the support body 1 by welding or the like, and a monolithic refractory 3.

The monolithic refractory 3 which covers the support body 1 has a single layer structure or a multi-layer structure. There may be cases where a shaped refractory such as a ceramic fiber, a heat insulating board, or a heat insulating sheet is used together with the monolithic refractory 3. The support body 1 is a structure obtained by combining metallic or ceramic members and is a furnace shell, pipe, beam, post, or the like. For example, as the support body 1 used in an iron and steel process, a furnace shell of a heating furnace, a water-cooling pipe of a skid, an immersion tube for secondary refining, a gas suction lance, or the like may be employed.

After the metal support materials 2 are fixed to the support body 1 with predetermined intervals therebetween by welding or the like, a slurry-like monolithic refractory raw material is poured into a molding box having an arbitrary shape installed in the periphery of the support body 1. Thereafter, through a finishing process such as curing process and drying process, a monolithic refractory structure as shown in FIG. 16 is obtained.

In a general monolithic refractory structure described above, a metal support material is present in the vicinity of the operation surface of a monolithic refractory exposed to a high temperature. The metal support material has a higher coefficient of thermal expansion than that of the monolithic refractory. Therefore, cracks occur in the monolithic refractory due to the difference in the coefficient of thermal expansion between the metal support material and the monolithic refractory. In addition, heat is transferred to the furnace shell, the water-cooling pipe, or the like via the metal support material having a high thermal conductivity and thus high heat loss occurs. Furthermore, in a case where the metal support material is used over a long period of time under an oxidizing atmosphere, the strength of the metal support material is reduced due to the oxidation. As a result, the holding force of the monolithic refractory is reduced, and particularly, there is a problem in that the monolithic refractory becomes separated from the tip end of the metal support material.

During the construction of the monolithic refractory structure of an industrial furnace, thousands to tens of thousands or hundreds of thousands of metal support materials are used although the number of materials varies depending on the size or structure of the furnace. In the monolithic refractory after an operation under a high temperature, many cracks that are initiated from positions where the metal support materials are installed are present. When such cracks propagate and are connected to each other, a possibility of peeling or separation of the monolithic refractory is increased. Therefore, the amount of initiated cracks is one of the factors that determine the life-span of the monolithic refractory structure.

Hitherto, as a countermeasure to the problem, in order to ensure the expansion allowance of the metal support material, a method of forming a resin film on the surface of a metal support material or winding a plastic tape around the surface thereof and thereafter burying the metal support material in a monolithic refractory is generally employed. According to this method, the resin film or the plastic tape is burned down due to the temperature increase, and thus a space (that is, expansion allowance) is formed in the periphery of the metal support material buried in the monolithic refractory.

However, according to the countermeasure of forming the resin film on the surface of the metal support material or winding the plastic tape around the surface thereof, it is difficult to sufficiently suppress the occurrence of cracks even though effort and cost is consumed.

Here, hitherto, a technique of using a heat-resistant fiber rope formed of an inorganic fiber as a support material instead of the metal support material is suggested (refer to the following Patent Documents 1 to 3). In Patent Documents 1 and 2, a technique of supporting a monolithic refractory using a heat-resistant ceramic rope formed of a ceramic fiber is disclosed. In Patent Document 3, a technique of using a rope (support cord) formed of an inorganic fiber such as glass wool, rock wool, slag wool, asbestos, ceramic fiber, alumina fiber, or carbon fiber as a support material is disclosed.

The inorganic fiber is formed of an inorganic material like the monolithic refractory and has a low coefficient of thermal expansion and has a further low elastic modulus. Therefore, in a case where the heat-resistant fiber rope is buried in the monolithic refractory as the support material, cracks hardly occur in the monolithic refractory due to a small difference in the thermal expansion between the monolithic refractory and the heat-resistant fiber rope.

In general, while the thermal conductivity of SUS steel or heat-resistant cast steel used for the metal support material is about 15 W/mK to 50 W/mK, for example, the thermal conductivity of alumina fiber is about 0.1 W/mK to 0.2 W/mK. Therefore, heat is hardly transferred to the furnace shell, the water-cooling pipe, or the like via the heat-resistant fiber rope, and thus heat loss can be reduced.

In addition, for example, the ceramic fiber is primarily formed of oxides such as $Al_2O_3$ and $SiO_2$. Therefore, even when the heat-resistant fiber rope formed of the ceramic fiber is used over a long period of time under a high temperature oxidizing atmosphere, deterioration due to the oxidation does not occur unlike the metal support material.

PRIOR ART DOCUMENT

Patent Document

[Patent Document 1] Japanese Unexamined Patent Application, First Publication No. H09-143535

[Patent Document 2] Japanese Unexamined Patent Application, First Publication No. 2005-42967

[Patent Document 3] Japanese Unexamined Utility Model Application, First Publication No. H07-32493

DISCLOSURE OF THE INVENTION

Problems to be Solved by the Invention

As described above, most of the problems that occur due to the use of the metal support material can be solved by using the heat-resistant fiber rope formed of the inorganic fiber as the support material instead of the metal support material. However, as a result of verification by the inventors, it was determined that the bearing force of the monolithic refractory (a force needed to fix the monolithic refractory to the support body) varies depending on the state of the heat-resistant fiber rope in the monolithic refractory.

That is, there is a possibility that a sufficient bearing force for the monolithic refractory may not be obtained depending on the state of the heat-resistant fiber rope in the monolithic refractory and the monolithic refractory may become separated from the support body. However, in the related art described above, there is no suggestion for an optimal state of the heat-resistant fiber rope in the monolithic refractory by focusing on the bearing force of the monolithic refractory.

The present invention has been made taking the foregoing circumstances into consideration, and an object thereof is to solve problems (a reduction in the bearing force of a monolithic refractory) that occur when a heat-resistant fiber rope formed of an inorganic fiber is used as a support material for supporting the monolithic refractory.

Measures for Solving the Problem

In order to accomplish the object to solve the problems, the present invention employs the following measures.

(1) According to an aspect of the present invention, a monolithic refractory structure includes: a monolithic refractory; a support body which supports the monolithic refractory; and a heat-resistant fiber support material which is buried in the monolithic refractory in a state of being connected to a support surface of the support body, in which the heat-resistant fiber support material includes a heat-resistant fiber rope which is formed of an inorganic fiber and extends along an X-axis direction perpendicular to the support surface, and a ratio L1/L2 of an X-axis direction length L1 of the heat-resistant fiber rope to an X-axis direction length L2 of the monolithic refractory is 0.35 or more and 0.95 or less.

Here, the description "extends along an X-axis direction" includes not only extension of the heat-resistant fiber rope in parallel to the X-axis direction, but also meaning that extension of the heat-resistant fiber rope in a state of being inclined at a predetermined angle from the X-axis direction is allowed as long as the condition that L1/L2 is 0.35 or more and 0.95 or less is satisfied.

(2) In the monolithic refractory structure described in (1), the heat-resistant fiber rope may be formed of an inorganic fiber made of a material containing one type or two or more types of $Al_2O_3$, $SiO_2$, $Al_2O_3$—$SiO_2$, and $Al_2O_3$—$SiO_2$—$B_2O_3$.

(3) In the monolithic refractory structure described in (1), the heat-resistant fiber rope may be hardened by a hardener.

(4) In the monolithic refractory structure described in (1), the heat-resistant fiber rope may be connected to the support body via an anchor provided on the support surface.

(5) In the monolithic refractory structure described in (1), the heat-resistant fiber support material may further include a connection member which connects the heat-resistant fiber rope to the support body, and the connection member may be fixed to the support surface of the support body.

(6) In the monolithic refractory structure described in (5), the connection member may be a metal ring having a hollow tube shape, the heat-resistant fiber rope may be inserted into and fixed to the metal ring, and a direction in which a load of the monolithic refractory is exerted on the heat-resistant fiber rope and a direction in which the heat-resistant fiber rope is pulled from the metal ring may be the same.

(7) In the monolithic refractory structure described in (5), the connection member may be a metal ring having a hollow tube shape, the heat-resistant fiber rope may be inserted into and fixed to the metal ring, and a direction in which a load of the monolithic refractory is exerted on the heat-resistant fiber rope and a direction in which the heat-resistant fiber rope is pulled from the metal ring may be different from each other.

(8) In the monolithic refractory structure described in (1), the heat-resistant fiber rope may include one or two or more annular portions.

(9) In the monolithic refractory structure described in (1), the heat-resistant fiber rope may include one or two or more knots.

(10) In the monolithic refractory structure described in (1), the monolithic refractory may be divided into a plurality of layers along the X-axis direction, and the heat-resistant fiber rope may have a single annular portion for each of the layers of the monolithic refractory.

Effects of the Invention

In the above aspect, the ratio L1/L2 of the X-axis direction (the direction perpendicular to the support surface of the support body; in other words, the direction where load of the monolithic refractory acts on) length L1 of the heat-resistant fiber rope to the X-axis direction length L2 of the monolithic refractory is 0.35 or more and 0.95 or less.

By holding the state of the heat-resistant fiber rope in the monolithic refractory so as to satisfy the condition described above, a necessary bearing force for the monolithic refractory can be obtained. As a result, the monolithic refractory can be prevented from being separated from the support body.

EMBODIMENT OF THE INVENTION

Hereinafter, an embodiment of the present invention will be described with reference to the drawings.

Figure 1A:
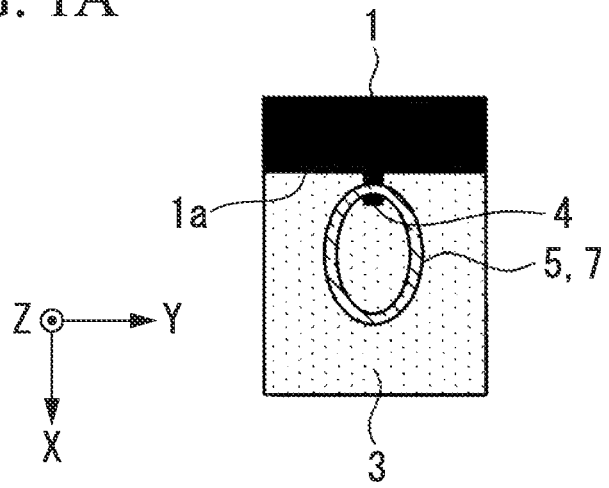
FIG. 1A is a plan view of a monolithic refractory structure according to an embodiment of the present invention.
Figure 1B:
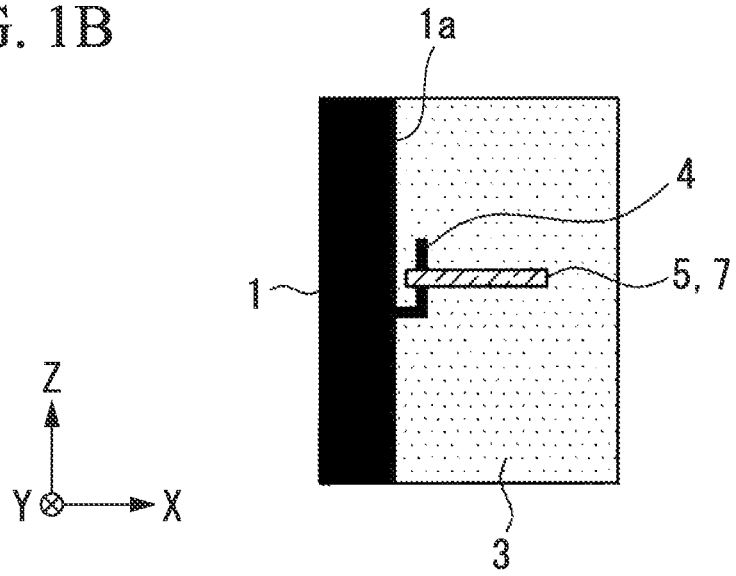
FIG. 1B is a side view of the monolithic refractory structure according to the embodiment of the present invention.

FIG. 1A is a plan view of a monolithic refractory structure according to this embodiment. FIG. 1B is a side view of the monolithic refractory structure according to this embodiment. As shown in FIGS. 1A and 1B, the monolithic refractory structure according to this embodiment includes a support body 1, a monolithic refractory 3, a pin 4, and a heat-resistant fiber support material 5.

Figure 16:
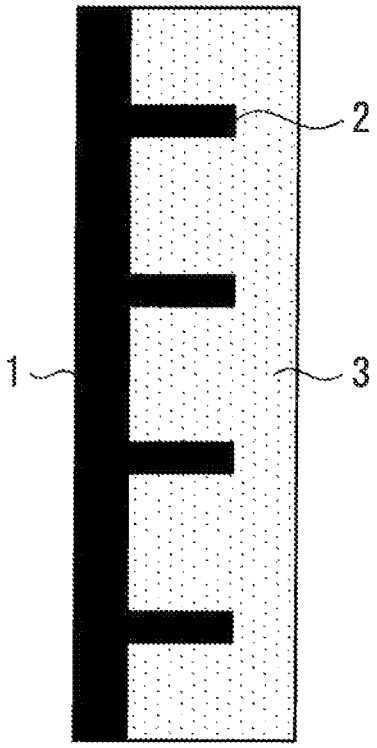
FIG. 16 is a view showing a monolithic refractory structure in which a metal support material according to the related art is used.

The support body 1 is a structure that supports the monolithic refractory 3 and is obtained by combining metallic or ceramic members. The support body 1 and the monolithic refractory 3 are the same as those of an existing monolithic refractory structure shown in FIG. 16. Therefore, for the convenience of description, the support body 1 and the monolithic refractory 3 in this embodiment are denoted by the same reference numerals as those in FIG. 16.

A planar support surface 1*a* is provided on the surface of the support body 1. Hereinafter, as shown in FIGS. 1A and 1B, a direction perpendicular to the support surface 1*a* is defined as an X-axis direction. In addition, on a plane perpendicular to the support surface 1*a*, a direction perpendicular to the X-axis direction is defined as a Y-axis direction. Moreover, a direction perpendicular to the XY plane (the plane perpendicular to the support surface 1*a*) is defined as a Z-axis direction.

The pin 4 having an L-shape is installed on the support surface 1*a*. The pin 4 has a role as an anchor to connect the support body 1 and the heat-resistant fiber support material 5 to each other.

The heat-resistant fiber support material 5 is buried in the monolithic refractory 3 in a state of being connected to the support surface 1*a* provided in the support body 1. The heat-resistant fiber support material 5 is formed of an inorganic fiber and has a heat-resistant fiber rope 7 that extends along the direction perpendicular to the support surface 1*a* (the X-axis direction in the figure). The heat-resistant fiber rope 7 is connected to the support body 1 via the pin 4 installed on the support surface 1*a*. In addition, the pin 4 forms a portion of the support body 1 and is not a constituent element of the heat-resistant fiber support material 5.

In FIGS. 1A and 1B, a case where the heat-resistant fiber rope 7 has an annular portion (the shape of the heat-resistant fiber rope 7 is annular) is shown. However, as described later, the shape of the heat-resistant fiber rope 7 is not limited to the annular shape. In addition, as described above, the heat-resistant fiber rope 7 may be fixed to the support body 1 by a method of hooking the annular heat-resistant fiber rope 7 to the pin 4, a method of connecting the heat-resistant fiber rope 7 to the support body 1 using a beam of the ceiling or the like of the support body 1, or the like.

It is preferable that the heat-resistant fiber rope 7 be formed of an inorganic fiber made of a material containing one type or two or more types of $Al_2O_3$, $SiO_2$, $Al_2O_3$—$SiO_2$, and $Al_2O_3$—$SiO_2$—$B_2O_3$. The heat-resistant fiber rope 7 formed of the inorganic fiber made of such the material has heat resistance and strength to bear a high temperature of, for example, 600° C. or higher, and furthermore, 1000° C. or higher at which an increase in heat loss and a reduction in strength occur in an existing metal support material.

Particularly, an inorganic fiber made of $Al_2O_3$—$SiO_2$ has excellent high temperature resistance and cost performance. Among the inorganic fibers made of $Al_2O_3$—$SiO_2$, an inorganic fiber containing 72 mass % of $Al_2O_3$ and 28 mass % of $SiO_2$ is relatively easily available and has excellent cost performance. In addition, an inorganic fiber containing 90 mass % of $Al_2O_3$ and 10 mass % of $SiO_2$ has more excellent heat resistance.

By twisting a plurality of inorganic fibers, a yarn is obtained. Furthermore, by joining a plurality of yarns to be processed into a rope shape, the heat-resistant fiber rope 7 which is a primary portion of the heat-resistant fiber support material 5 according to this embodiment is obtained.

In addition, by using the inorganic fiber containing two or more types of $Al_2O_3$, $SiO_2$, $Al_2O_3$—$SiO_2$, and $Al_2O_3$—$SiO_2$—$B_2O_3$ as described above, for example, the heat-resistant fiber rope 7 which has a multi-layer structure in which the core and the outer layer have different materials can be obtained.

In a case where the monolithic refractory structure is used under a low temperature, for example, the heat-resistant fiber rope 7 formed of an inorganic fiber (carbon fiber) made of carbon or an inorganic fiber made of $Al_2O_3$—$SiO_2$—CaO, CaO—$SiO_2$, or the like may be used.

The heat-resistant fiber rope 7 has a rope form braided by using the inorganic fiber. As the type of braiding, 8 strands braiding (cross rope), 16 strands braiding (braided rope), solid cord braiding (solid cord), or the like may be employed, and the type is not particularly limited. A hollow rope such as sleeve may also be used. However, the space in the rope is preferably as small as possible.

In order for the heat-resistant fiber rope 7 to ensure strength to function as the support material of the monolithic refractory 3, it is preferable that the heat-resistant fiber rope 7 be formed of long fibers having a fiber length of, for example, 100 m or longer. Even in a case where short fibers are used, the short fibers may be braided into a rope shape. However, the short fibers are only entangled and thus are easily pulled. Therefore, the short fibers do not accomplish the function as the support material. In a case where the long fibers are used, a necessary tensile strength for the support material can be adjusted by changing the rope diameter. In addition, long fiber indicates a fiber having a long fiber length on the order of meters or longer (typically, on the order of kilometers or longer) and is distinguished from short fiber having a fiber length of about 1 mm to 50 mm.

Figure 2A:
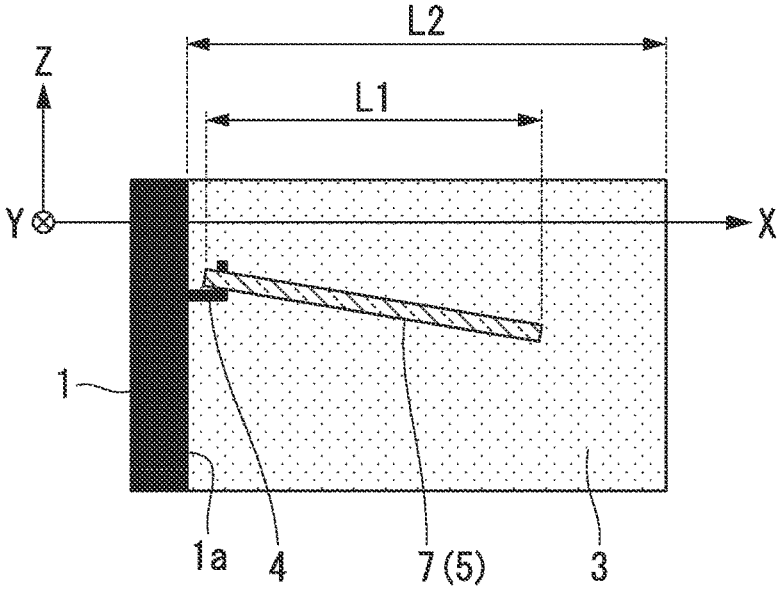
FIG. 2A is a view showing a case where the ratio L1/L2 of an X-axis direction length L1 of a heat-resistant fiber rope to an X-axis direction length L2 of a monolithic refractory is 0.35 or more and 0.95 or less.

As shown in FIG. 2A, in the monolithic refractory structure according to this embodiment, the state of the heat-resistant fiber rope 7 is held in the monolithic refractory 3 so that the ratio L1/L2 of an X-axis direction length L1 of the heat-resistant fiber rope 7 to an X-axis direction length L2 of the monolithic refractory 3 is 0.35 or more and 0.95 or less.

As described above, as a result of verification by the inventors, it was determined that the bearing force of the monolithic refractory 3 (a force needed to fix the monolithic refractory to the support body) varies depending on the state of the heat-resistant fiber rope 7 in the monolithic refractory 3.

After the heat-resistant fiber rope 7 (the heat-resistant fiber support material 5) is fixed to the support body 1, a slurry-like raw material of the monolithic refractory 3 is poured into a molding box having an arbitrary shape installed in the periphery of the support body 1. Thereafter, through a finishing process such as curing process and drying process, the monolithic refractory structure according to this embodiment is obtained.

Figure 2B:
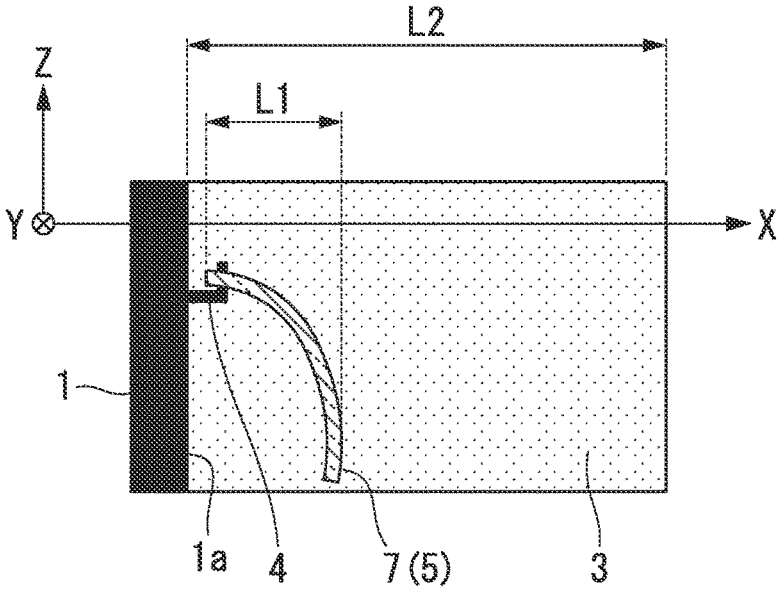
FIG. 2B is a view showing a case where the ratio L1/L2 of the X-axis direction length L1 of the heat-resistant fiber rope to the X-axis direction length L2 of the monolithic refractory is smaller than 0.35.

Here, as shown in FIG. 2B, before the raw material of the monolithic refractory 3 is poured into the molding box, the heat-resistant fiber rope 7 is hung downward in the Z-axis direction (vertically downward) due to its own weight. When the raw material of the monolithic refractory 3 is poured into the molding box in the state where the heat-resistant fiber rope 7 is hung down as such, the heat-resistant fiber rope 7 is fixed in the monolithic refractory 3 in the state where the heat-resistant fiber rope 7 is hung down.

The inventors verified an effect of the ratio L1/L2 of the X-axis direction length L1 of the heat-resistant fiber rope 7 to the X-axis direction length L2 of the monolithic refractory 3 on the bearing force of the monolithic refractory 3. As a result, it was discovered that as shown in FIG. 2B, in a case where the ratio L1/L2 of the X-axis direction length L1 of the heat-resistant fiber rope 7 to the X-axis direction length L2 of the monolithic refractory 3 is smaller than 0.35 since the heat-resistant fiber rope 7 is fixed in the monolithic refractory 3 in the state where the heat-resistant fiber rope 7 is hung down, the bearing force of the monolithic refractory 3 is significantly reduced.

The reasons are as follows. That is, in a case where the monolithic refractory structure according to this embodiment is used in an actual industrial furnace or facility, the X-axis direction (the direction perpendicular to the support surface 1*a*) becomes a direction in which the load of the monolithic refractory 3 is exerted. Since the bearing force of the monolithic refractory 3 is a force that bears the load, it is thought that when the heat-resistant fiber rope 7 is hung down and the X-axis direction length L1 of the heat-resistant fiber rope 7 is reduced, the bearing force that bears the load (that is, a force in a direction opposite to the load in the X-axis direction) is reduced.

In a case where the ratio L1/L2 of the X-axis direction length L1 of the heat-resistant fiber rope 7 to the X-axis direction length L2 of the monolithic refractory 3 is smaller than 0.35, a portion of the monolithic refractory 3 that is not supported by the heat-resistant fiber rope 7 is about ⅔ of the X-axis direction length L2 of the monolithic refractory 3, and thus there is a possibility that the portion that is not supported by the heat-resistant fiber rope 7 may be easily separated from the support body 1.

In a case where the ratio L1/L2 of the X-axis direction length L1 of the heat-resistant fiber rope 7 to the X-axis direction length L2 of the monolithic refractory 3 is greater than 0.95, the tip end of the heat-resistant fiber rope 7 (an end portion thereof on the opposite side to the support body 1) is too close to the operation surface of the monolithic refractory 3 (a surface thereof on the opposite side to the support body 1), and there is a possibility that the heat resistance of the heat-resistant fiber rope 7 may have a problem.

In addition, it was confirmed that as long as the condition (L1/L2 is 0.35 or more and 0.95 or less) is satisfied, even when the heat-resistant fiber rope 7 is inclined downward in the Z-axis direction (vertically downward) with respect to the X-axis direction, if the angle between the heat-resistant fiber rope 7 and the X-axis direction is 45° or less, there is no problem in practical use.

Therefore, by holding the state of the heat-resistant fiber rope 7 in the monolithic refractory 3 so as to satisfy the condition (L1/L2 is 0.35 or more and 0.95 or less) described above, a necessary bearing force for the monolithic refractory 3 can be obtained. As a result, the monolithic refractory 3 can be prevented from being separated from the support body 1.

In order to hold the state of the heat-resistant fiber rope 7 in the monolithic refractory 3 so that the condition (L1/L2 is 0.35 or more and 0.95 or less) is satisfied as described above, it is preferable that the heat-resistant fiber rope 7 which is hardened in advance by a hardener or the like be used. Accordingly, before the raw material of the monolithic refractory 3 is poured into the molding box, the heat-resistant fiber rope 7 can be prevented from being hung down due to its own weight.

As described above, a state in which the heat-resistant fiber rope 7 is hardened in advance by the hardener and the strength of the heat-resistant fiber rope 7 is exhibited at room temperature during the construction of the monolithic refractory structure according to this embodiment is preferable. Strength indicates a force that bears deformation such as hanging, curving, or bending of the heat-resistant fiber rope 7 due to its own weight during the construction. As the hardener, a resin such as a commercially available oil varnish which is volatilized in a temperature rising procedure may be employed. The heat-resistant fiber rope 7 may also be molded into an arbitrary shape by fixing the heat-resistant fiber rope 7 and hardening the heat-resistant fiber rope 7 using the hardener.

In addition, a phenolic resin or coal-tar pitch which is carbonized in a high temperature region and maintains strength, or phosphoric acid, phosphate, silicate, silica sol, alumina sol, or the like which forms a vitreous network in a high temperature region may also be used as the hardener.

The heat-resistant fiber rope 7 has many spaces in its structure and can contain a large amount of moisture. One of the factors that determine the quality accuracy of the monolithic refractory 3 is the amount of added moisture. However, in a case where the heat-resistant fiber rope 7 is used, for the above-described reason, moisture is absorbed by the heat-resistant fiber rope 7 and the fluidity of the monolithic refractory 3 disappears. The use of the hardener has an effect of burying the internal spaces of the heat-resistant fiber rope 7 and thus also has an effect of preventing moisture of the monolithic refractory 3 from being absorbed by the heat-resistant fiber rope 7. Therefore, by using the heat-resistant fiber rope 7 that is hardened by the hardener, the quality of the monolithic refractory 3 is also enhanced.

In addition, in the related art documents (Patent Documents 1 to 3) described above, holding the state of the heat-resistant fiber rope 7 in the monolithic refractory 3 so as to satisfy the above-described condition in order to obtain a necessary bearing force, or means for holding the state (burying the heat-resistant fiber rope 7 in the monolithic refractory 3 in a state of being hardened by the hardener or the like) is not disclosed. Therefore, it is difficult for those skilled in the art to discover the present invention based on the related art documents.

Figure 4:
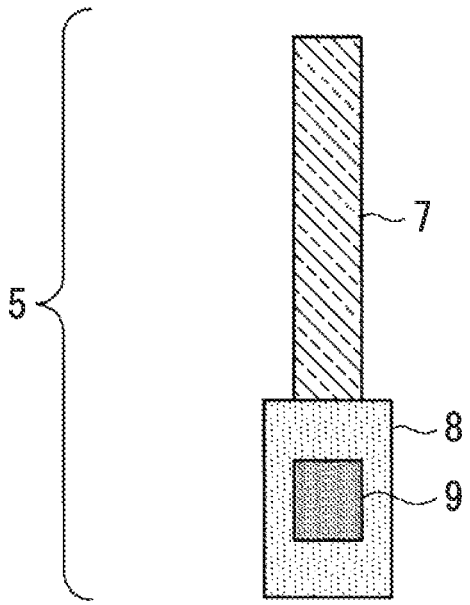
FIG. 4 is a view showing a heat-resistant fiber support material including the heat-resistant fiber rope and a metal ring.
Figure 5:
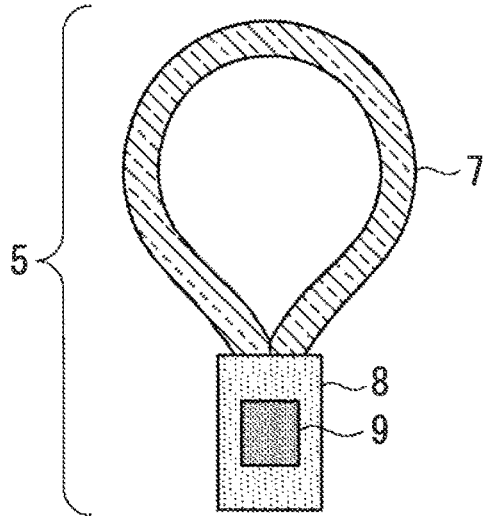
FIG. 5 is a view showing the heat-resistant fiber support material including the heat-resistant fiber rope and the metal ring.

The heat-resistant fiber support material 5 may have only the heat-resistant fiber rope 7 (see FIGS. 1A and 1B) or may also have the heat-resistant fiber rope 7 and a connection member (see FIGS. 4 and 5). The connection member has a function of connecting the heat-resistant fiber rope 7 and the support body 1 to each other, and a metal ring 8 and the like, which will be described later, correspond to the connection member.

Figure 6:
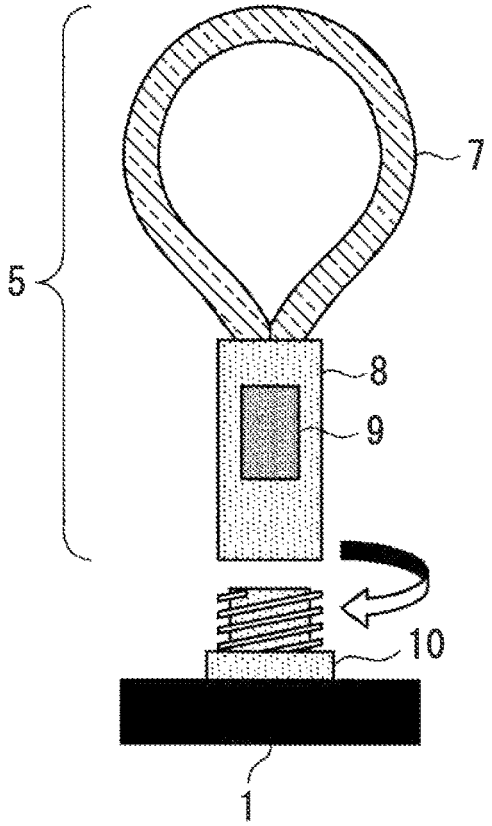
FIG. 6 is a view showing the heat-resistant fiber support material including the heat-resistant fiber rope and the metal ring.
Figure 7:
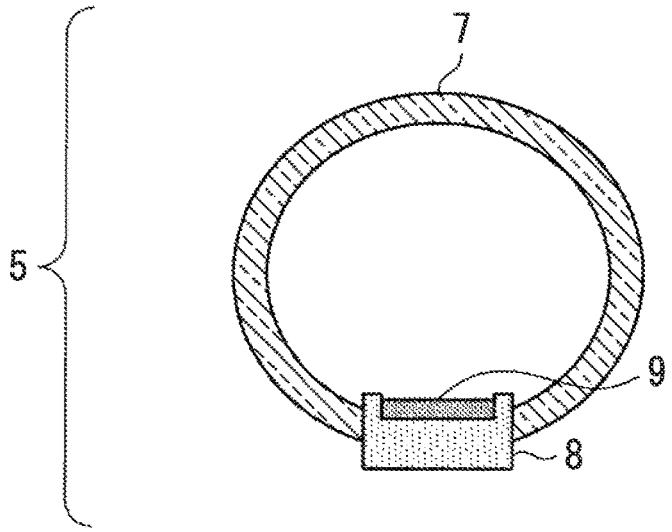
FIG. 7 is a view showing the heat-resistant fiber support material including the heat-resistant fiber rope and the metal ring.

As shown in FIGS. 1A and 1B, by burying the annular heat-resistant fiber rope 7 obtained by connecting both ends of the heat-resistant fiber rope 7 in the monolithic refractory 3, the bearing force of the monolithic refractory 3 is increased compared to a case where a linear heat-resistant fiber rope is buried in the monolithic refractory 3. In addition, in a case where the heat-resistant fiber rope 7 is provided with the annular portion, as shown in FIGS. 1A and 1B, the entirety of the heat-resistant fiber rope 7 may be annular, and as shown in FIGS. 5 to 7 described later, at least a portion of the heat-resistant fiber rope 7 may be annular. The number of annular portions installed in the heat-resistant fiber rope 7 may be one or an arbitrary number of two or more. For example, when the number of installed annular portions is two, the heat-resistant fiber rope 7 has an 8 shape.

Figure 3:
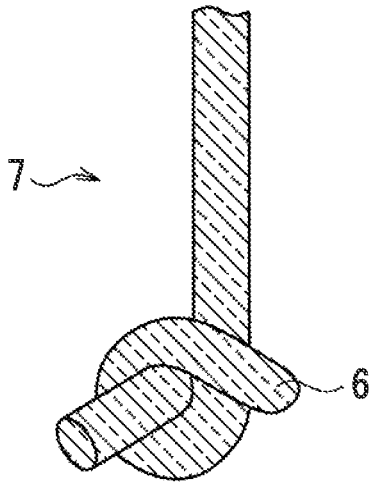
FIG. 3 is a view showing a knot portion of a heat-resistant fiber support material.

Furthermore, as shown in FIG. 3, a knot 6 may be provided at an arbitrary position of the heat-resistant fiber rope 7. The knot 6 functions as a resistive portion and may further increase the bearing force of the monolithic refractory 3. The number of knots 6 is not particularly limited, and one or two or more knots 6 may be provided for a single heat-resistant fiber rope 7.

Particularly in a case where the heat-resistant fiber support material 5 is used for the ceiling wall, the load of the monolithic refractory 3 is always exerted on the heat-resistant fiber support material 5 (that is, the heat-resistant fiber rope 7). When the shape of the heat-resistant fiber rope 7 is linear, the load of the monolithic refractory 3 is beared by the frictional resistance of the heat-resistant fiber rope 7 against the monolithic refractory 3. Therefore, in this case, peeling of the monolithic refractory 3 off from the heat-resistant fiber rope 7 easily occurs. By providing the knot 6 in the heat-resistant fiber rope 7, the heat-resistant fiber rope 7 can receive the load with the knot 6. As a result, the bearing force of the monolithic refractory 3 is increased, and thus the monolithic refractory 3 can be prevented from peeling off from the support body 1.

In a case where the monolithic refractory structure according to this embodiment is applied to various types of industrial furnaces and facilities, there may be many cases where the heat-resistant fiber support material 5 is fixed to the support body 1 made of metal, such as a shell or a water-cooling pipe. In consideration of workability and adhesion strength to the shell, it is preferable that the heat-resistant fiber support material 5 include the heat-resistant fiber rope 7 and the connection member made of metal and the connection member be fixed to the support body 1 made of metal, such as a shell, by welding. In a state where one end portion or both end portions of the heat-resistant fiber rope 7 are nipped by the connection member made of a material capable of being fixed to the support body 1 by welding, the connection member is fixed to the support body 1, thereby attaching the heat-resistant fiber rope 7 to the support body 1.

For example, as shown in FIG. 4, in a case where the metal ring 8 is used as the connection member made of metal, it is preferable that one end portion of the heat-resistant fiber rope 7 be inserted into and fixed to the metal ring 8. The metal ring 8 has a metal member having a hollow tube shape with a through-hole therein. The metal ring 8 has a structure capable of clamping the end portion of the heat-resistant fiber rope 7 inserted into the through-hole thereof. The metal ring 8 can be easily fixed to the support body 1 by welding. In a state where the end portion of the heat-resistant fiber rope 7 is surrounded by the metal ring 8 (for a folded metal plate), the heat-resistant fiber rope 7 and the metal ring 8 are crimped by a press such that a crimped portion 9 is formed in the metal ring 8. Accordingly, the heat-resistant fiber support material 5 having a structure in which the end portion of the heat-resistant fiber rope 7 is not easily pulled from the connection member such as the metal ring 8 even in a case where a load or thermal stress is exerted on the heat-resistant fiber support material 5 in the monolithic refractory 3 can be obtained.

In addition, as shown in FIG. 5, the heat-resistant fiber support material 5 having a structure in which both end portions of the heat-resistant fiber rope 7 that is bent into an annular shape are inserted into and fixed to the metal ring 8 (or a folded metal plate) may also be used. As described above, by using the heat-resistant fiber support material 5 having the annular heat-resistant fiber rope 7, compared to a case where the heat-resistant fiber support material 5 having the linear heat-resistant fiber rope 7 shown in FIG. 4 is used, the contact area between the monolithic refractory 3 and the heat-resistant fiber rope 7 is increased. As a result, the friction between the monolithic refractory 3 and the heat-resistant fiber rope 7 is increased, and an effect of increasing the shape stability of the heat-resistant fiber rope 7 is obtained. Shape stability indicates a small degree of deformation from the original shape of the heat-resistant fiber rope 7 during the construction of the monolithic refractory 3. In addition, since the monolithic refractory 3 is present straddling the annular heat-resistant fiber rope 7, the heat-resistant fiber rope 7 can receive the load of the monolithic refractory 3 with its surface. As a result, a higher bearing force can be obtained.

Even in the embodiment shown in FIG. 5, as in the embodiment shown in FIG. 4, it is preferable that by welding the connection member made of metal to the support body 1 made of metal, such as a shell, the heat-resistant fiber support material 5 be fixed to the support body 1. For example, it is preferable that an end portion of the metal ring 8 in which the end portion of the heat-resistant fiber rope 7 is pressed be welded and fixed to a region in the support body 1, such as a furnace shell or pipe, where the monolithic refractory 3 is constructed. After the heat-resistant fiber support material 5 is fixed to the support body 1 as described above, the monolithic refractory 3 can be constructed in the same manner as the typical metal support material 2. When this method is used, only the same welding operation as that of the metal support material 2 is performed, and thus efficiency in the operation of installing support members is the same.

Otherwise, the connection member of the heat-resistant fiber support material 5 is not welded to the support body 1, and the connection member may be indirectly fixed to the support body 1 by using an additional fixing member. For example, as shown in FIG. 6, a bolt 10 having threads is welded to the support body 1 such as a shell in advance, and the heat-resistant fiber support material 5 which uses the metal ring 8 provided with an inner groove corresponding to the bolt 10 may be screwed to the bolt 10 such that the two are fixed to each other.

In the embodiment shown in FIG. 5, in the portion of the heat-resistant fiber rope 7 connected to the metal ring 8, a direction in which the load of the monolithic refractory 3 is exerted on the heat-resistant fiber rope 7 (the X-axis direction) and a direction in which the heat-resistant fiber rope 7 is pulled from the metal ring 8 are the same. In other words, the metal ring 8 is fixed to the support surface 1*a* so that the center axis of the metal ring 8 is parallel to the X-axis direction.

In contrast to this, in an embodiment shown in FIG. 7, a direction in which the load of the monolithic refractory 3 is exerted on the heat-resistant fiber rope 7 (the X-axis direction) and a direction in which the heat-resistant fiber rope 7 is pulled from the metal ring 8 (the Y-axis direction or the Z-axis direction) are the different from each other. In other words, the metal ring 8 is fixed to the support surface 1*a* so that the center axis of the metal ring 8 is parallel to a direction perpendicular to the X-axis direction (the Y-axis direction or the Z-axis direction). Accordingly, the heat-resistant fiber rope 7 is hardly separated from the metal ring 8. As a result, an increase in the service life of the heat-resistant fiber support material 5 can be realized. Particularly, as shown in FIG. 7, in a case where the direction in which the load of the monolithic refractory 3 is exerted on the heat-resistant fiber rope 7 and the direction in which the heat-resistant fiber rope 7 is pulled from the metal ring 8 are perpendicular to each other, the heat-resistant fiber rope 7 is hardly pulled from the metal ring 8. In this case, for example, both end portions of the heat-resistant fiber rope 7 are respectively inserted into openings provided at both left and right sides of the metal ring 8. Thereafter, in a state where both end portions of the heat-resistant fiber rope 7 overlap each other at the center portion of the metal ring 8, the center portion of the metal ring 8 is clamped such that the heat-resistant fiber rope 7 is fixed to the metal ring 8.

Figure 8:
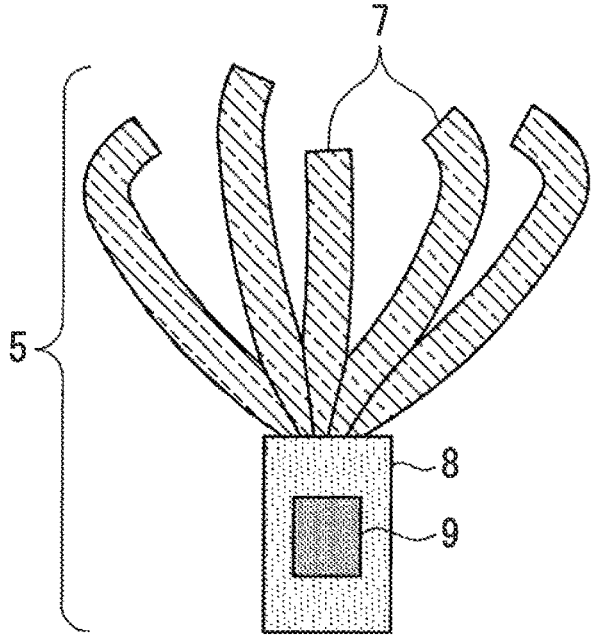
FIG. 8 is a view showing the heat-resistant fiber support material including a plurality of heat-resistant fiber ropes which branch off from the metal ring into a branch shape.

In addition to the annular heat-resistant fiber rope 7 described above, as shown in FIG. 8, a plurality of heat-resistant fiber ropes 7 which branch off from the metal ring 8 into a branch shape may also be used. As the contact area between the heat-resistant fiber rope 7 and the monolithic refractory 3 is increased, the friction between the monolithic refractory 3 and the heat-resistant fiber rope 7 is also increased. Therefore, by using the heat-resistant fiber support material 5 having the plurality of heat-resistant fiber ropes 7 which branch off from the metal ring 8 into the branch shape as shown in FIG. 8, the bearing force of the monolithic refractory 3 can be enhanced.

Figure 9:
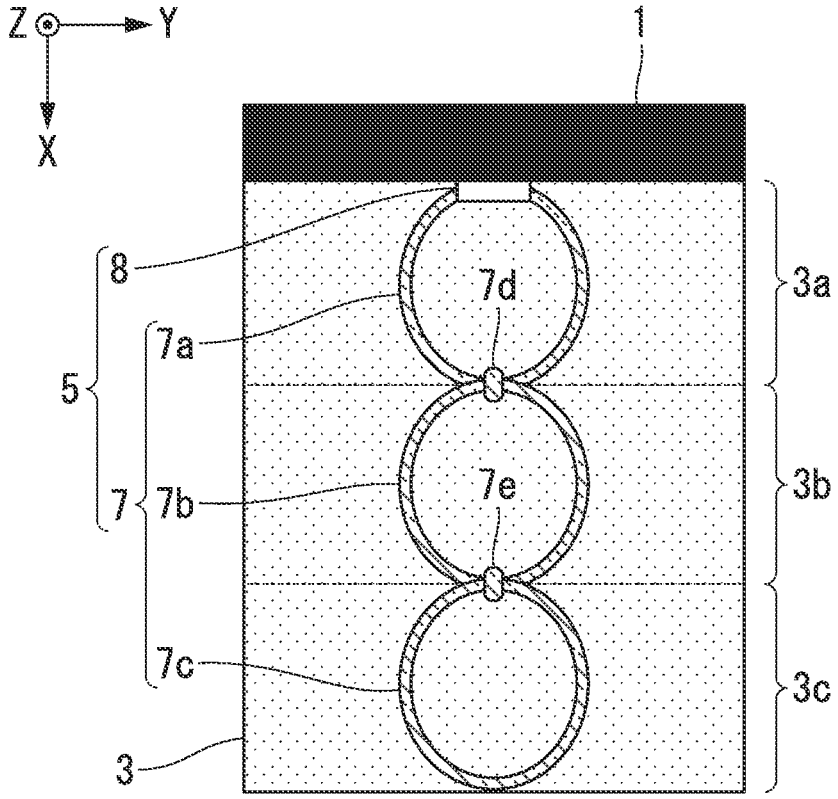
FIG. 9 is a view showing the heat-resistant fiber support material in a case where the monolithic refractory is divided into a plurality of layers.

Moreover, as shown in FIG. 9, in a case where the monolithic refractory 3 is divided into a plurality of layers (for example, three layers) along the X-axis direction, the heat-resistant fiber rope 7 may have a single annular portion for each of the layers of the monolithic refractory 3. Specifically, the heat-resistant fiber rope 7 shown in FIG. 9 has a first annular portion 7*a* for a first layer 3*a* of the monolithic refractory 3, a second annular portion 7*b* for a second layer 3*b* of the monolithic refractory 3, and a third annular portion 7*c* for a third layer 3*c* of the monolithic refractory 3.

In addition, in FIG. 9, reference numeral 7*d* denotes a knot between the first annular portion 7*a* and the second annular portion 7*b*. In addition, reference numeral 7*e* denotes a knot between the second annular portion 7*b* and the third annular portion 7*c*.

As described above, by using the heat-resistant fiber rope 7 having one annular portion for each of the layers of the monolithic refractory 3, even though the third annular portion 7*c* is cut due to deterioration or the like, the bearing force of the monolithic refractory 3 can be held by the first annular portion 7*a* and the second annular portion 7*b* which are normal.

In FIG. 9, a case where the heat-resistant fiber rope 7 is connected to the support body 1 by the metal ring 8 (the connection member) is shown. However, as shown in FIGS. 1A and 1B, the heat-resistant fiber rope 7 may also be directly connected to an anchor such as the pin 4 installed in the support body 1 in advance.

The heat-resistant fiber support material 5 according to this embodiment may also be used together with another support material according to the related art. For example, in a case where a large load of the monolithic refractory 3 is applied to the support body such as a ceiling, a metal support material which obtains a relatively high bearing force, a hanger brick, or the like may also be used together with the heat-resistant fiber support material 5.

The heat-resistant fiber support material 5 according to this embodiment and the monolithic refractory structure using the same can be applied to points where the metal support material according to the related art and the monolithic refractory structure using the same are applied in various types of industrial furnaces and facilities. In addition, the heat-resistant fiber support material 5 according to this embodiment may be applied to substitute the total amount or a portion of a metal support material at a position where the metal support material is used hitherto. Particularly, in a case where the support body 1 or the support body is cooled by water-cooling or air-cooling, heat lost from the furnace body is reduced in the heat-resistant fiber support material 5 compared to the metal support material, and thus the heat-resistant fiber support material 5 is effective.

As an example of the facilities, a skid of a heating furnace for rolling a steel piece may be employed. A skid is a facility for supporting and transporting the steel piece in the heating furnace. The skid includes pipes made of metal and has a structure in which the insides of the pipes are water-cooled for the purpose of maintaining hot strength and the outer periphery thereof is coated with a refractory insulating material to suppress water-cooling loss. At this time, when the water-cooling pipes are not insulated, heat transferred from the heating furnace to cooling water is increased, and great heat loss occurs as a result.

Figure 10:
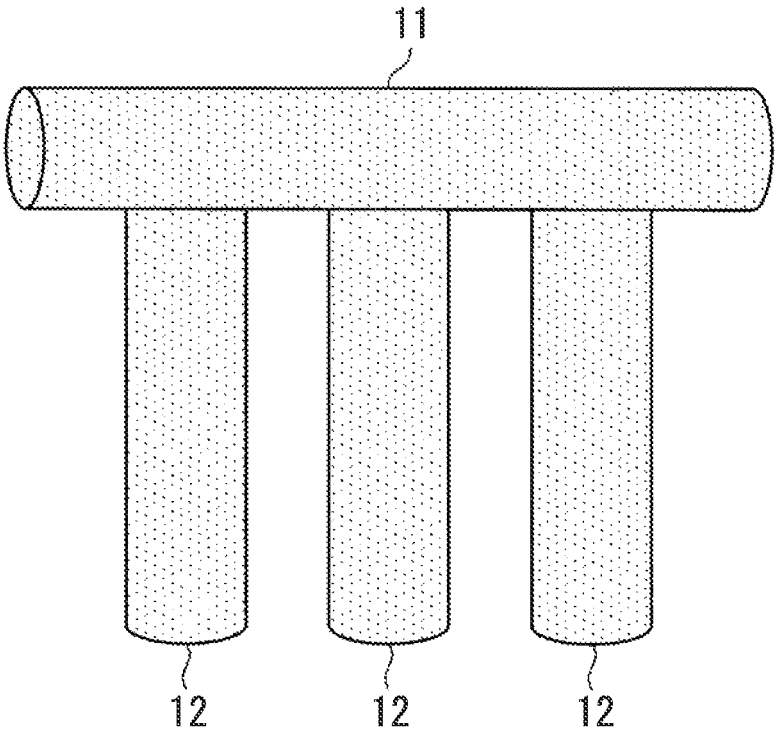
FIG. 10 is a view showing a skid.
Figure 11:
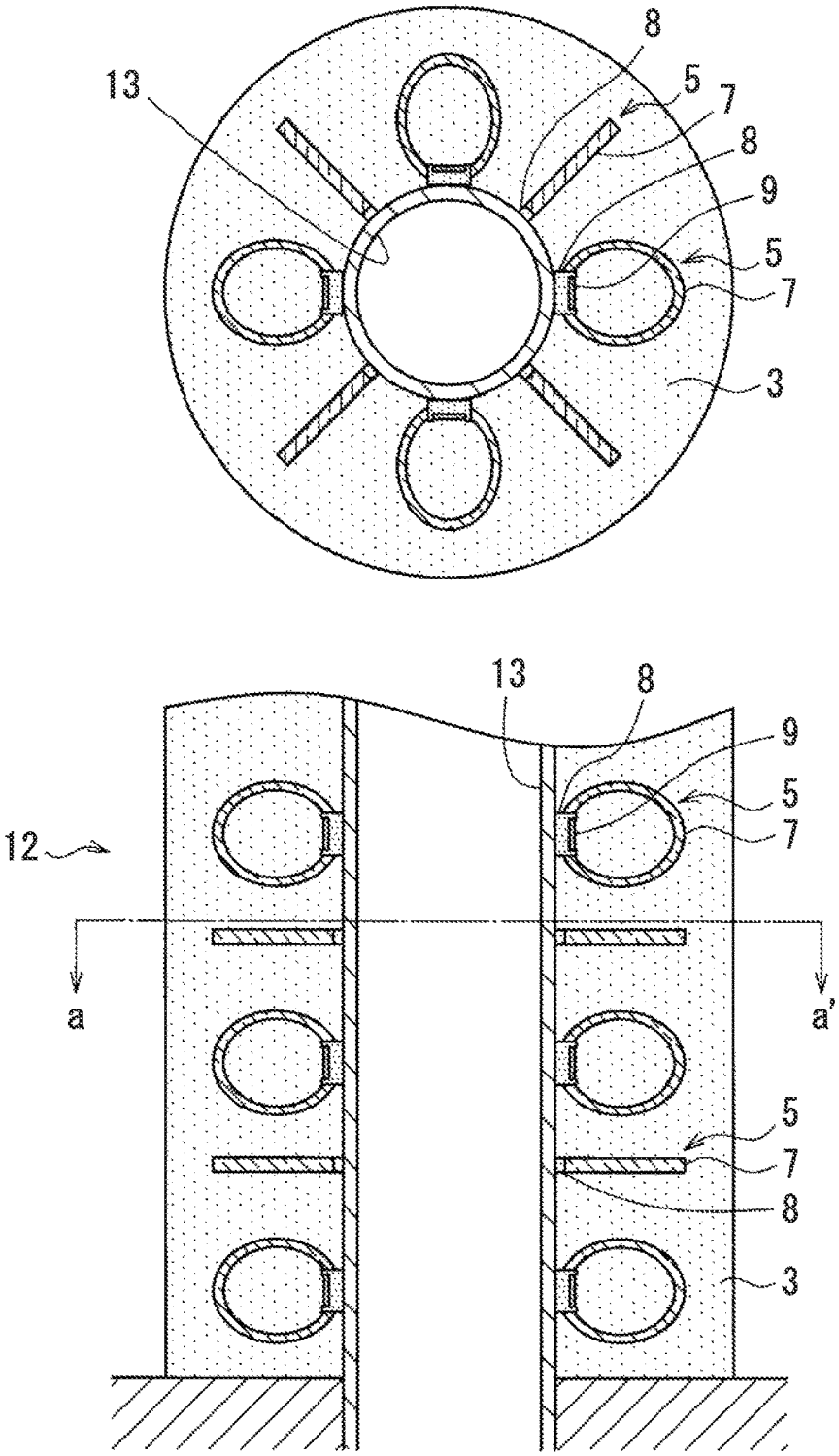
FIG. 11 is a view showing the structure of a skid post.

As shown in FIG. 10, the basic structure of the skid includes a beam portion 11 corresponding to a beam, and post portions 12 corresponding to posts. For example, as shown in FIG. 11, in order to apply the monolithic refractory structure according to this embodiment to the post portions 12, the heat-resistant fiber support material 5 shown in FIG. 7 may be welded to a water-cooling pipe 13 as the support body 1 of the monolithic refractory 3, and the monolithic refractory 3 may be constructed by being poured into the periphery of the water-cooling pipe 13 so as to cover the heat-resistant fiber support material 5.

EXAMPLES

Hereinafter, heat-resistant fiber support materials and monolithic refractory structures according to Examples of the present invention will be described in detail. The present invention is not limited to the following Examples.

The heat-resistant fiber rope 7 having a diameter of 5 mm was formed by using long fibers having a composition of 72 mass % of $Al_2O_3$ and 28 mass % of $SiO_2$ as an inorganic fiber. The tensile strength of the heat-resistant fiber rope 7 at room temperature was 50 MPa. The tensile strength of the heat-resistant fiber rope 7 after being baked at 1200° C. for 5 hours was 40 MPa.

Example 1

Figure 12:
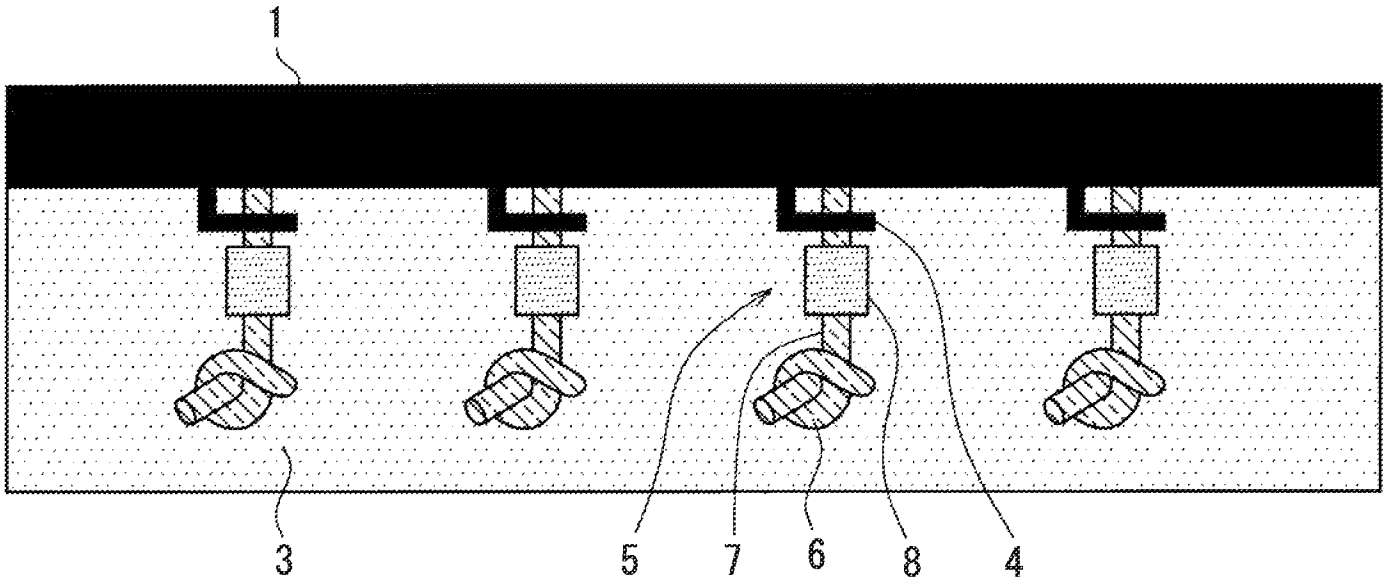
FIG. 12 is a view showing the monolithic refractory structure in which the heat-resistant fiber support material is used.

As shown in FIG. 12, as a resistive portion for preventing separation of the heat-resistant fiber rope 7, the knot 6 was provided in one end portion of the heat-resistant fiber rope 7. In addition, an annular portion was provided in the other end portion of the heat-resistant fiber rope 7, and an end portion thereof was inserted into the metal ring 8 (corresponding to the connection member made of metal) which was made of SUS steel and had a height of 20 mm and an inner diameter of 10 mm and was pressed to press the rope portion of the heat-resistant fiber rope 7 and the metal portion of the metal ring 8, thereby producing a heat-resistant fiber support material 5. At this time, the height of the heat-resistant fiber support material 5 was set to 140 mm. The annular portion of the heat-resistant fiber rope 7 of the heat-resistant fiber support material 5 was hooked and fixed to an L-shaped pin 4 installed in advance at the ceiling shell (corresponding to the support body 1) of a heating furnace. Thereafter, the periphery thereof was enclosed by a molding box, and a slurry-like raw material of a monolithic refractory 3 was poured thereinto, and through curing and drying processes, a constructed body having a thickness of 210 mm was obtained (Invention Example 1).

After operating the heating furnace at an operation temperature of 1350° C. for six months, the status of the constructed body of the monolithic refractory 3 was checked. It was confirmed that the heat-resistant fiber support material 5 could be used in an actual machine of the heating furnace without problems such as cracking.

Example 2

Both end portions of the heat-resistant fiber rope 7 were inserted into the metal ring 8 which was made of SUS steel and had a height of 20 mm and an inner diameter of 10 mm to form an annular portion and were pressed to press the rope portion and the metal portion, thereby producing a heat-resistant fiber support material 5 having the form shown in FIG. 5. Furthermore, the heat-resistant fiber rope 7 was allowed to be impregnated with oil varnish as a hardener and thereafter was dried and cured to increase the strength of the heat-resistant fiber rope 7.

Figure 13:
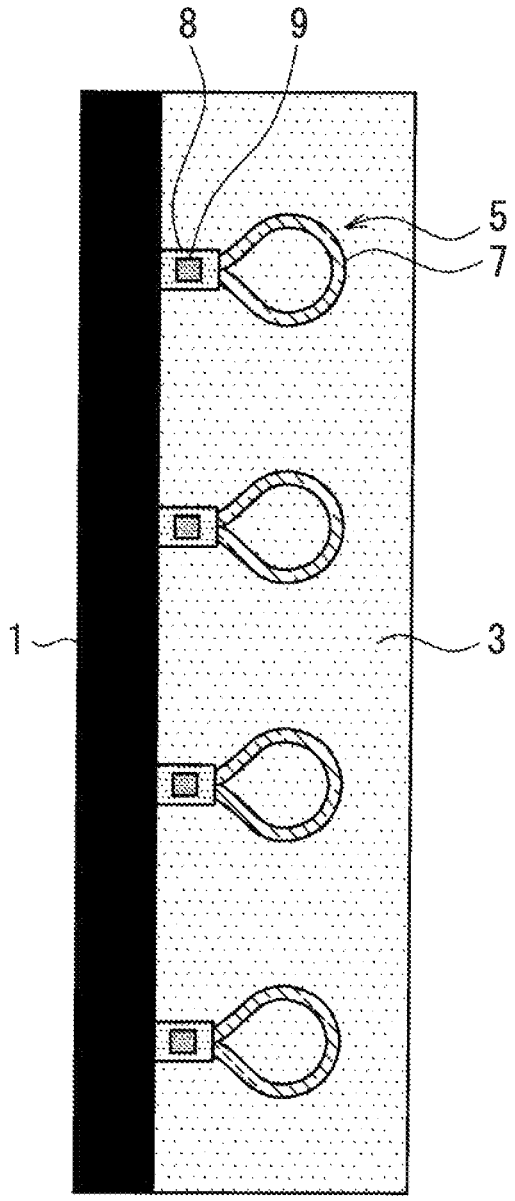
FIG. 13 is a view showing the monolithic refractory structure in which the heat-resistant fiber support material is used.

As shown in FIG. 13, the heat-resistant fiber support materials 5 were welded to the inner wall shell (corresponding to the support body 1) of the side wall of the heating furnace at an operation temperature of 1350° C. with a pitch of 150 mm vertically and horizontally, and the monolithic refractory 3 were poured and constructed to have a thickness of 210 mm (Invention Example 2).

Figure 14:
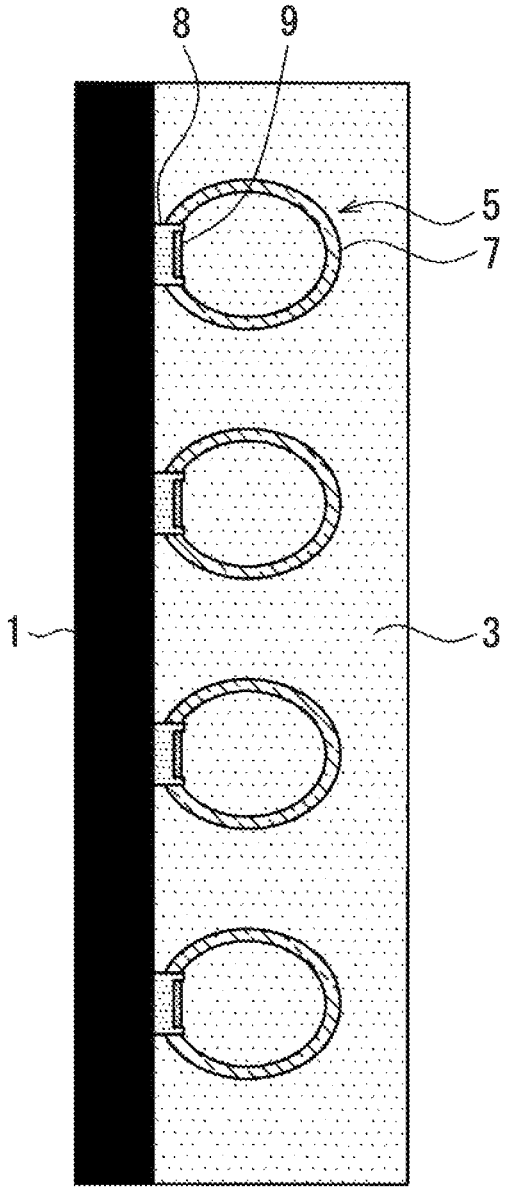
FIG. 14 is a view showing the monolithic refractory structure in which the heat-resistant fiber support material is used.

In the same manner, as shown in FIG. 14, the same construction was adopted by using the heat-resistant fiber support material 5 having the form shown in FIG. 7. The heat-resistant fiber support material 5 shown in FIG. 14 had a different configuration from the configuration of the heat-resistant fiber support material 5 shown in FIG. 13 in that the direction of the metal ring 8 was changed by 90°. In the example of FIG. 14, a direction in which the load of the monolithic refractory 3 was exerted on the heat-resistant fiber rope 7 and a direction in which the heat-resistant fiber rope 7 was pulled from the metal ring 8 are different from each other (Invention Example 3).

Figure 15:
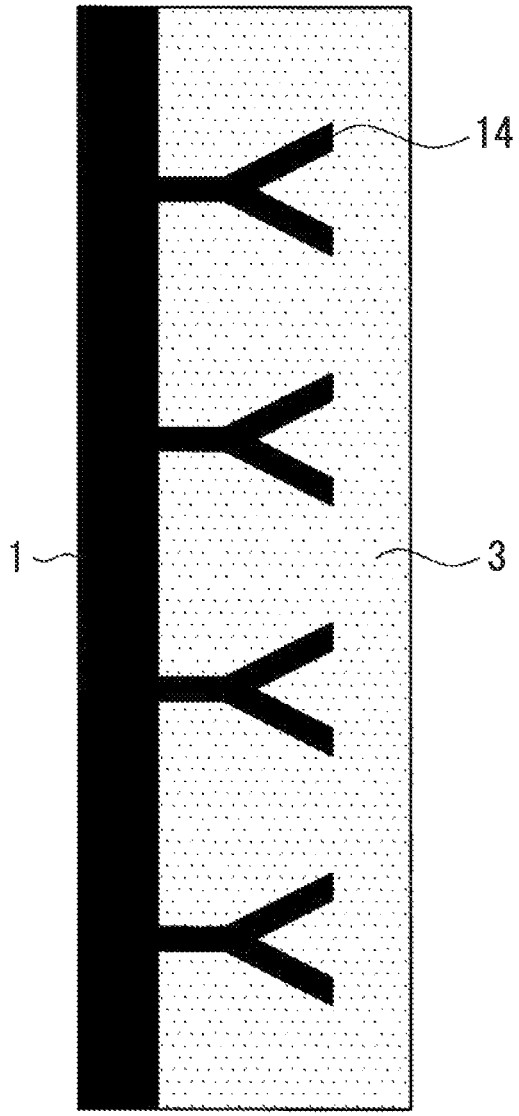
FIG. 15 is a view showing the monolithic refractory structure in which a metal support material is used.

Furthermore, as shown in FIG. 15, for comparison, the same construction was adopted by using a Y-shaped metal support material 14 (Y-shaped stud) which was made of SUS304 and had a diameter of 5 mm under the same conditions (Comparative Example 1).

At this time, the heights of all of the heat-resistant fiber support materials 5 of Invention Examples 1 to 3 and the metal support material 14 of Comparative Example 1 were 140 mm.

When the back surface temperature of the shell of the heating furnace during an operation is measured by a thermo viewer, while the back surface temperature of the shell was 130° C. in cases of Invention Examples 2 and 3 using the heat-resistant fiber support material 5, the back surface temperature of the shell was 160° C. in cases of Comparative Example 1 using the metal support material 14. Therefore, there was a temperature difference of about 30° C. between the back surface temperature of the shell of Invention Examples 2 and 3 and the back surface temperature of Comparative Example 1, and it could be confirmed that by using the heat-resistant fiber support material 5, heat loss could be reduced by about 30 percent in terms of heat dissipated from the shell.

When each of the monolithic refractory structures was observed after the operation of the heating furnace, in the cases of Invention Examples 2 and 3 in which the heat-resistant fiber support material 5 was used, no cracks on the operation surface (the surface of the monolithic refractory 3) were confirmed. However, in the cases of Comparative Example 1 in which the metal support material 14 was used, a crack occurred in the monolithic refractory 3 from a position where the support material 14 was installed as the origin and propagated in a cross shape. When a crack propagates by repeating heating and cooling, peeling and separation of the monolithic refractory 3 occur. However, it could be confirmed that when the heat-resistant fiber support material 5 was used, the life-span of the monolithic refractory 3 was enhanced.

In addition, the heat-resistant fiber support material 5 was recovered after being used in an actual machine for about one year, and the strength of the portion of the heat-resistant fiber rope 7 which was clamped by the metal ring 8 was measured in a tensile test. As a result, in Invention Example 2, the strength was reduced by about 20 percent from that before use, and in Invention Example 3, the strength was rarely deteriorated. Therefore, in the actual machine, long-term stability of the heat-resistant fiber support material 5 having the structure shown in FIG. 7 could be confirmed.

Therefore, Invention Example 2 has no problem in practical use. However, Invention Example 3 obtains higher strength.

Example 3

Both end portions of the heat-resistant fiber rope 7 were inserted into the metal ring 8 which was made of SUS steel and had a height of 20 mm and an inner diameter of 10 mm to form an annular portion and were pressed to press the rope portion and the metal portion, thereby producing a heat-resistant fiber support material 5 having the form shown in FIG. 7. Furthermore, the heat-resistant fiber rope 7 was allowed to be impregnated with oil varnish as a hardener and thereafter was dried and cured to increase the strength of the heat-resistant fiber rope 7.

As shown in FIG. 11, the heat-resistant fiber support material 5 was applied to the water-cooling pipe 13 of the skid post of the heating furnace having an operation temperature of 1350° C. Regarding the arrangement of the heat-resistant fiber support materials 5, eight heat-resistant fiber support materials 5 were arranged in the circumferential direction of the water-cooling pipe 13, and the interval between the heat-resistant fiber support materials 5 in the height direction was set to 150 mm. At this time, the directions of the metal rings 8 of the eight heat-resistant fiber ropes 7 arranged in the circumferential direction of the water-cooling pipe 13 were alternately set to a vertical direction and a horizontal direction. In addition, the end portion of the heat-resistant fiber support material 5 was welded and fixed to the outer circumferential surface of the water-cooling pipe 13. The monolithic refractory 3 was poured and constructed by setting the thickness thereof to 110 mm (Invention Example 4).

In addition, for comparison, the same construction was adopted by using the metal support material 14 (Y-shaped stud) which was made of SUS304 under the same conditions (Comparative Example 2).

At this time, the heights of both of the heat-resistant fiber support materials 5 of Invention Example 4 and the metal support material 14 of Comparative Example 2 were 80 mm.

The heating value of cooling water was calculated on the basis of the temperature difference between the inlet and the outlet of the cooling water in the water-cooling pipe 13 in the skid during the operation. In the case of Invention Example 4 in which the heat-resistant fiber support material 5 was used, compared to Comparative Example 2 in which the metal support material 14 was used, the heating value of the cooling water was reduced and the fuel unit consumption [Mcal/ton] was reduced by about ½. Here, the fuel unit consumption is an index that represents energy used per 1 ton of produced steel piece, and an increase in the fuel unit consumption means an increase in the heating value of the cooling water through the water-cooling pipe 13, that is, an increase in energy loss.

In addition, as in the case of Comparative Example 1, in Comparative Example 2 in which the metal support material 14 was used, a crack had occurred in the monolithic refractory 3 from the position where the support material 14 was installed as the origin. However, in Invention Example 4 in which the heat-resistant fiber support material 5 was used, no cracks on the operation surface (the surface of the monolithic refractory 3) were confirmed.

From the above-described results, it could be confirmed that the application of the present invention contributes to a reduction in cost, energy saving, and an increase in the life-span of the monolithic refractory structure by reducing heat loss energy.

While the exemplary embodiments of the present invention have been described in detail with reference to the accompanying drawings, the present invention is not limited to the examples. It is apparent that various modified examples and corrected examples can be made by those skilled in the art to which the present invention belongs without departing from the technical idea of the appended claims, and it is understood that these examples naturally belong to the technical scope of the present invention.

BRIEF DESCRIPTION OF THE REFERENCE SYMBOLS

1 SUPPORT BODY
2 METAL SUPPORT MATERIAL
3 MONOLITHIC REFRACTORY
4 PIN (ANCHOR)
5 HEAT-RESISTANT FIBER SUPPORT MATERIAL
6 KNOT
7 HEAT-RESISTANT FIBER ROPE
8 METAL RING (CONNECTION MEMBER)
9 CRIMPED PORTION
10 BOLT
11 BEAM PORTION
12 POST PORTION
13 WATER-COOLING PIPE
14 METAL SUPPORT MATERIAL

The invention claimed is:

1. A monolithic refractory structure comprising:
a monolithic refractory;
a support body which supports the monolithic refractory; and
a heat-resistant fiber support material which is buried in the monolithic refractory in a state of being connected to a support surface of the support body,
wherein the heat-resistant fiber support material includes a heat-resistant fiber rope which is formed of an inorganic fiber and extends along an X-axis direction perpendicular to the support surface,
a ratio L1/L2 of an X-axis direction length L1 of the heat-resistant fiber rope to an X-axis direction length L2 of the monolithic refractory is 0.35 or more and 0.95 or less,
the heat-resistant fiber rope includes one or more annular portions,
the heat-resistant fiber rope is hardened by a hardener, the hardener being oil varnish, coal-tar pitch, phosphoric acid, phosphate, silicate, silica sol, or alumina sol,
the heat-resistant fiber support material further includes a connection member which connects the heat-resistant fiber rope to the support body,
the connection member is fixed to the support surface of the support body,
the connection member is a metal ring having a hollow tube shape,
the heat-resistant fiber rope is inserted into and fixed to the metal ring, and
a direction in which a load of the monolithic refractory is exerted on the heat-resistant fiber rope and a direction in which the heat-resistant fiber rope is pulled from the metal ring are different from each other.

2. The monolithic refractory structure according to claim 1,
wherein the heat-resistant fiber rope is formed of an inorganic fiber made of a material containing one type or two or more types of $Al_2O_3$, $SiO_2$, $Al_2O_3$—$SiO_2$, and $Al_2O_3$—$SiO_2$—$B_2O_3$.

3. The monolithic refractory structure according to claim 1, wherein the heat-resistant fiber rope includes one or two or more knots.

4. The monolithic refractory structure according to claim 1, wherein the monolithic refractory is divided into a plurality of layers along the X-axis direction, and the heat-resistant fiber rope has a single annular portion for each of the layers of the monolithic refractory.

5. The monolithic refractory structure according to claim 1, wherein the heat-resistant fiber rope is formed of an inorganic fiber made of a material containing one or more types of $SiO_2$, $Al_2O_3$—$SiO_2$, or $Al_2O_3$—$SiO_2$—$B_2O_3$.

* * * * *